United States Patent [19]

Belland

[11] Patent Number: 4,944,332

[45] Date of Patent: Jul. 31, 1990

[54] BEVERAGE DISPENSER FOR FILLING CUPS AND EXTRA-LARGE RECEPTACLES WITH AUTOMATIC DISPENSING SHUT OFF

[75] Inventor: Terrance G. Belland, Champlin, Minn.

[73] Assignee: The Cornelius Company, Anoka, Minn.

[21] Appl. No.: 96,983

[22] Filed: Sep. 14, 1987

Related U.S. Application Data

[63] Continuation-in-part of Ser. No. 880,464, Jun. 30, 1986, Pat. No. 4,738,285.

[51] Int. Cl.[5] ..... B65B 3/04

[52] U.S. Cl. ..... 141/1; 141/83; 141/95; 141/198; 141/88; 141/378; 141/369

[58] Field of Search ..... 141/1, 87, 88, 198, 141/206, 369, 83, 94–96, 86, 378

[56] References Cited

U.S. PATENT DOCUMENTS

| | | | |
|---|---|---|---|
| 3,094,154 | 6/1963 | Daniels | 141/88 |
| 4,236,553 | 12/1980 | Reichenberger | 141/198 |
| 4,738,285 | 4/1988 | Belland | 141/198 X |
| 4,753,277 | 6/1988 | Holcomb et al. | 141/95 |

*Primary Examiner*—Ernest G. Cusick
*Attorney, Agent, or Firm*—Henry C. Kovar

[57] ABSTRACT

An improved drip tray for a beverage dispenser, an improved cold carbonated beverage dispenser and a kit for retrofitting existing beverage dispensers into the improved beverage dispenser have a drip tray with a front nose which is extended and spaced upward of and forward of an original drip tray and cup rest, and wings which extend transversely outward beyond sides of the dispenser. An improved and enlarged receptacle rest extends to the nose and across both wings. The improved dispenser handles both standard sized cups and extra large beverage receptacles of at least one quart volume, specific examples of which are 44 oz. cups and pitchers, while providing automatic unattended shut off of dispensing in response to sensing of the level of beverage being adjacent to the upper rim of any of the standard or extra large receptacles, and complete and stable unattended support of the extra large receptacles during dispensing and shut off. Methods of dispensing with extra large receptacles and for retrofitting an existing dispenser to handle extra large receptacles are also provided.

25 Claims, 3 Drawing Sheets

BEVERAGE DISPENSER FOR FILLING CUPS AND EXTRA-LARGE RECEPTACLES WITH AUTOMATIC DISPENSING SHUT OFF

RELATED APPLICATIONS

This application is a co-pending continuation-in-part application based upon U.S. Ser. No. 880,464 filed June 30, 1986, now U.S. Pat. No. 4,738,285 of Apr. 19, 1988.

BACKGROUND OF THE INVENTION

1. Field of the Invention

This invention pertains to a new and improved method and structure for filling any beverage receptacle selected from a plurality of standard sized cups or an extra large beverage receptacle with carbonated beverage, having automatic shut off of dispensing when the carbonated beverage level reaches or approaches the rim of the beverage receptacle, and with complete and stable support of the extra large receptacle during dispensing and shut off.

2. The Prior Art

The use of a tilted open topped receptacle for filling has been well known and used since at least as early as the 1900's.

U.S. Pat. No. 763,136 has a continuous canning line wherein open top cans are filled firstly with solids and then secondly with liquid. The filled can is then tilted to spill out any excess liquid so that when the cans leave the tilting area and are returned to vertical, the cans all have an identical fill and identical head space. The cans are thereafter topped and closed.

Subsequent canning lines have been utilized wherein the open topped cans are filled while tilted. Cans are now being filled with liquids, mixtures of solids and liquids, and flowable solids while tilted. When the cans are returned to upright, even and consistent fills and head spaces are provided regardless of can size. Examples of state-of-the-art fillers of tilted cans and bottles are made by Solbern Corporation of Fairfield N.J. and a typical specific example is shown in B. C. Eisenberg U.S. Pat. 4,349,053.

W. C. Buttner et al U.S. Pat. No. 2,055,923 teaches that a glass or like beverage receptacle should be placed beneath a pour spout and disposed at an angle or tilt from vertical and to the spout so that beverage discharged from the spout will hit the side of a glass at a slight angle to minimize carbonation loss and foaming.

S. D. Levings U.S. Pat. No. 2,598,665 teaches a carbonated soft drink dispenser having a cup support which will hold the cup at an angle with respect to the user and with respect to vertical, and to the dispenser so that the forward side of the cup is slightly higher than the back, serving to confine any overflow to the rear of the cup and improve the appearance of the cup of beverage after filling. The cup is canted rearwardly at an angle of approximately 10 degrees. The cup has its rear top edge below the bottom of a dispensing nozzle.

Both Buttner and Levings were assigned to Bastian Blessing Co. of Chicago.

Lawrence D. McIntosh U.S. Pat. No. 3,916,963 is also directed specifically to beverage dispensing and teaches the concept of and structure for manual start and automatic shut off of dispensing by utilizing an electrically conductive combination actuator and beverage probe lever that engages a cup and electrically contacts and senses the dispensed beverage when the beverage reaches or approaches the rim of the cup.

Arthur M. Reichenberger U.S. Pat. No. 4,236,553 is a development after McIntosh. Reichenberger provided energization of the beverage and signal current flow through the flowing beverage stream during dispensing, through the beverage in the cup and to the combination actuation and beverage probe lever. An elongate, straight electrically conductive actuator and probe lever has a sliding angled projection to electrically engage the beverage in various heights of cups. This particular device did not satisfy sanitation criteria and while having been field tested and found operable, it has not been commercially successful as of this date.

Clay Bennett U.S. Pat. No. 4,641,692 is generally similar to Reichenberger, except that Bennett has removed the sliding probe of Reichenberger which Reichenberger used to get a shut off below the rim of the cup. Although not disclosed in Bennett, commercial embodiments of Bennett's device sold by Bennett's assignee use a cup rest which is tilted toward the electrically conductive combination actuator and beverage probe lever so that the cup is rearwardly tilted during dispensing and shut off, with a lowest point of the cup rim being in physical contact with the probe. After shut off and when the cup is removed and returned to vertical (upon a horizontal surface), the beverage is below the rim by about ½ the amount of the tilt of the cup rim. When the cup is on a horizontal cup rest and standing vertically as shown in Reichenberger, the beverage can go upon and over the cup rim anywhere on its diameter and not necessarily where the probe is. Were this to happen, the dispenser would not shut off. The tilted cup rest is a solution to the problem of being certain of shut off before beverage overflowed out of the cup someplace other than where the cup contacted the probe.

D. E. Holcomb et al in co-pending U.S. Ser. No. 824,819 filed on Jan. 31, 1986, has devised an improved McIntosh type structure with a low moment combination actuator and beverage prove lever utilizing a high strength low mass tubular lever arm mounted on a dielectric journal to give improved electrical isolation. A heater element in the lever arm provides high temperature which can keep the lever arm sterile. Holcomb further shows and teaches that the use of a relatively simple tilted cup rest with a McIntosh type automatic filling control is well know. Holcomb has also provided an electrically conductive plastic lever and probe that is dielectrically isolated from its fulcrum to prevent premature shut off of dispensing.

F. Brill U.S. Pat. No. 3,913,792 has a receptacle rest with a bottom mounted stop on a horizontal support surface for stopping a variety of cups below a nozzle. Brill's stop acts directly upon the bottom of a cup.

Where we are with McIntosh, Reichenberger, Bennett and Holcomb is that we have a device that will now automatically shut off with various sized cups or glasses, regardless of the size of the cup, provided the cups are of reasonable height and volume and they fit upon and in the dispenser. Specifically very small containers and extra large containers are not usable, but typical standard sized beverage cups in the range of 6–16 ounces are quite acceptable. While these devices have offered measurable and economically important savings of time and increases in productivity, further opportunities and problems have been realized.

Mathews U.S. Pat. No. 4,590,974 teaches a dispenser having tilted bottle rest in a complete beverage dispenser which was designed from scratch to fill two liter plastic (PET) beverage bottles while the bottles are tilted on and supported by a bottle rest which is completely within an existing spill trough.

Many of the beverage and food establishments serve dispensed beverage in cups or glasses and significantly larger beverage receptacles. For example, draft beer retailers will sell small glasses, mugs, and/or large pitchers of beer. Soft drink retailers such as pizza parlors and hamburger houses will serve small and medium and large cups and also very large pitchers of soft drinks. The standard sized cups are typically of paper and are relatively lightweight, collapsible, and of low strength. The pitcher is usually glass or plastic and weighs at least a couple of pounds. A filled pitcher of soft drink might easily weigh up to 6 pounds.

The devices of McIntosh, Reichenberger, Bennett and Holcomb have not worked reliably with pitchers. When a pitcher is placed upon the cup rest the pitcher is too large and may fall off of either the front or the side of the cup rest, therefore requiring that the pitcher be manually held in place during filling whereupon the automatic shut off feature and structure becomes redundant because there is no productivity increase or labor savings. Then the pitcher is so heavy and bulky that it bends the actuator and probe levers, and/or breaks the actuator switches connected to the levers after which the dispenser will not work. Further its been found that the relatively heavy filled pitcher tends to slide down on the inclined cup rest and again bend the lever, break the actuator switch, or bend the dispensing valve mount. Most dispensers have a stainless steel splash panel behind the cup rest and the dispensing valves. If and when the combination beverage probe and actuator lever is pushed against the splash panel by a pitcher, the automatic fill control is disabled by electrical shunting.

Farmer et al U.S. Pat. No. 4,572,253 teaches an ultrasonic cup fill control for a dispenser. This control has an emitter/receiver and electronic logic. This system senses the presence of a cup and starts dispensing, senses the height of the cup with a weak reflection, senses the level of dispensed beverage with a strong reflection and automatically terminates dispensing when the difference between the weak and strong reflection indicates the cup is filled to a specific distance below its rim. This system has not been developed for extra large receptacles of more than a quart, or for pitchers. No effective method, kit, or structure has been devised for retrofitting existing dispensers to utilize this system with other than standard sized cups of less than a quart capacity.

Extra large cups, specifically cups of capacity greater than a quart do not work with the existing embodiments of McIntosh, Reichenberger, Bennett, Holcomb, or Farmer. The reason they do not work is that they are diametrically too large and they fall off of the dispenser if they are not manually held in place. As soon as an employee has to hold the cup in place, the greatest economic advantage of the automatic shut off is negated. The greatest economic advantage is that the employee can walk away during dispensing and do other work to increase output and decrease serving time. Typical extra large beverage cups that are being used as of this date are 28 oz., 32 oz., and 44 oz. capacity. The volume of the extra large cups is trending to be larger and the extreme largest limit has not been determined.

These problems have not yet been addressed or solved, and as of this date there is no known automatic fill control that will work and be commercially satisfactory with the dispensing of carbonated beverage into pitchers, extra large cups, and a variety of standard sized cups or glasses.

There are several hundred thousand beverage dispensers presently in use, that require the constant attention and attendance of a foodservice employee during filling of cups, let alone pitchers and extra large cups which have to be manually held and supported and then manually manipulated for shut off. This is an undesirable and relatively costly and inefficient usage of employee time. A solution to the problems of automatic filling and shut off for pitchers and extra large cups needs to be found, and a solution enabling retrofit of existing dispensers to that they will automatically dispense into either extra large cups or pitchers needs to be provided.

OBJECTS OF THE INVENTION

It is an object of the present invention to provide improved carbonated beverage dispensers for filling any receptacle selected from a group of standard sized cups of less than a quart and an extra large receptacle of at least one quart, with automatic shut off of dispensing when the beverage level in the receptacle reaches or approaches the receptacle upper rim.

It is an object of the present invention to provide improved drip trays having an extended nose and wings which extend outwardly beyond the sides of a dispenser for complete support of an extra large beverage receptacle, at least partially, beyond the side of a dispenser.

It is an object of the present invention to provide new kits for retrofitting a cold carbonated beverage dispenser into an improved carbonated beverage dispenser which will fill any beverage receptacle selected from a group of standard sized cups of less than a quart and an extra large cup of at least a quart, with automatic shut off of dispensing when beverage reaches the selected receptacle rim and with complete support of the extra large receptacle.

It is an object of the present invention to provide new methods of dispensing cold carbonated beverage into any receptacle selected from a group of standard size cups of less than a quart and an extra large cup which is at least a quart, with automatic shut off of dispensing in response to beverage reaching the rim of the selected receptacle and with complete and full support of the extra large receptacle.

It is an object of the present invention to provide new methods of retrofitting a carbonated beverage dispenser into an improved carbonated beverage dispenser which will fill any receptacle selected from a group of standard sized cups of less than a quart and an extra large receptacle of at least one quart, with automatic shut off of dispensing in response to sensing of beverage at a level adjacent the selected receptacle rim and with complete support of the extra large receptacle during dispensing.

SUMMARY OF THE INVENTION

An improved cold carbonated beverage dispenser has a housing, a plurality of electrically operable beverage dispensing valves, a cup rest support below the valves, an elongate electrically conductive beverage probe between the support and at least one valve, a dispensing switch for the one valve, an automatic control electrically connected to the dispensing switch and the valve, an improved drip tray on the support and having an outer nose extending upward of and forward beyond the support, and an improved receptacle rest extending over and forward beyond the support and to the drip tray nose; the improved dispenser will fill any receptacle selected from a group of standard sized cups of less than a quart and an extra large receptacle of at least a quart, with automatic shut off of dispensing when beverage is electrically sensed at the rim of the selected receptacle and with complete and stable support of the base of an extra large receptacle when it is the selected receptacle.

An improved carbonated beverage dispenser drip tray has support structure for engaging the dispenser and positioning the tray under a dispensing valve, a wing extending outward beyond each end of the support structure, a nose extending across the drip tray and the wings with the nose being forward of and spaced upward of the support structure, and a canted support for supporting a beverage receptacle rest adjacent the top of the tray and in a position canted rearwardly and downwardly towards the dispensing valve.

A kit for retrofitting a beverage dispenser into an improved carbonated beverage dispenser has a combination beverage level probe and actuator lever, an electronic dispensing control electrically connectible to the probe and to a solenoid operated dispensing valve with the control having structure for electrically sensing when dispensed beverage reaches the rim of a receptacle, an improved drip tray having a nose extending upward of and forward of an outer edge of an original drip tray on the dispenser, a canted support in the improved drip tray and an improved and enlarged receptacle rest extending at a canted angle upward and outward to the nose; the kit enables the retrofitted dispenser to fill any receptacle selected from a group of standard cups and an extra large receptacle of at least a quart with automatic shut off and complete and stable support of the extra large receptacle during dispensing.

A method of dispensing cold carbonated beverage from a dispenser into any beverage receptacle selected from a group of standard sized cups which are less than a quart and an extra large receptacle which is of at least one quart with automatic shut off of dispensing when beverage reaches the rim of the selected receptacle has the steps of selecting the receptacle, moving the selected receptacle rearward upon and downwardly on a tilted receptacle rest and into physical control with an electrically conductive beverage probe, starting dispensing, electrically sensing the beverage adjacent the rim of the selected receptacle, automatically terminating dispensing upon electrical sensing of the beverage, and completely supporting the base of the selected receptacle on an enlarged and inclined beverage receptacle support which is extended upward and outward beyond a footprint of an original cup rest which was on the dispenser.

A method of retrofitting a cold carbonated beverage dispenser into an improved dispenser that will fill both standard and extra large receptacles with automatic shut off when beverage reaches an upper rim of the selected receptacle has the steps of removing an original cup rest from the dispenser, providing an electrically conductive beverage probe for at least one dispensing valve, installing an electronic control electrically in combination with the probe and a solenoid on the dispensing valve with the control having structure for turning off dispensing when the probe and control electrically senses beverage adjacent the rim of a container, installing an improved and enlarged drip tray upon the dispenser with the enlarged tray having a nose which extends upward of and outward beyond the original cup rest, and installing an improved and enlarged receptacle rest which is inclined downwardly toward the probe and which extends outward to the nose for complete and stable support of the extra large container during dispensing and automatic shut off.

An improved carbonated beverage dispenser for filling any of the aforementioned receptacles has a housing, a dispensing switch connected to start dispensing from at least one valve on the housing, a beverage level sensing automatic receptacle fill control connected to the dispensing valve for automatically shutting off the valve, and an improved and enlarged drip tray with an improved and enlarged receptacle rest for unattended support of any of the cup or the extra large receptacles with respect to the control and during dispensing and shut off.

A method of manually dispensing carbonated beverage has the steps of selecting a receptacle from a group of standard cups and at least one extra large receptacle of at least a quart capacity, starting dispensing after the receptacle is in place, electrically sensing for the beverage level in the receptacle, automatically terminating dispensing when beverage is adjacent the upper rim of the selected receptacle and completely supporting the extra large receptacle above and beyond the footprint of an original cup rest on the dispenser.

A kit for retrofitting a carbonated beverage dispenser has structure for sensing the presence of any one of the aforesaid receptacles, automatic fill control structure response to beverage level in the selected receptacle, and an improved and enlarged drip tray and receptacle rest for support of extra large receptacles at least in part beyond an original footprint of an original cup rest.

A method of retrofitting a manual carbonated beverage dispenser has the steps of removing an original cup rest, providing at least one dispensing valve with structure for sensing the level of dispensed beverage, installing an electronic control to shut off the valve in response to sensing of beverage at a level adjacent a receptacle rim, and installing an improved and enlarged drip tray and receptacle rest for complete unattended support of extra large beverage receptacles with respect to the beverage level sensing structure.

These and other objects and advantages of this invention will become manifest to those versed in art upon study of the teaching herein.

DESCRIPTION OF THE PREFERRED EMBODIMENT

Figure 1:
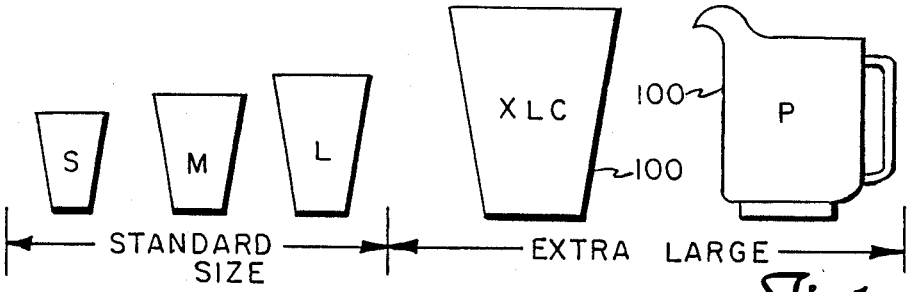
FIG. 1 is an illustration of standard sized and extra large beverage receptacles.

FIG. 1 illustrates the standard sized small, medium, and large beverage receptacles, respectively indicated by S, M and L. These standard receptacles are typically single use paper or plastic cups but may be reusable glasses or mugs. These S, M and L receptacles are typically and standardly sized to have fluid capacities of about 8, 12 and 6–24 fluid ounces respectively. In any event, the standard sized receptacle is less than one quart capacity. These standard sized receptacles have been in common public use for about a decade.

Some beverage retailers, such as convenience stores, fast food chains, and theatres are beginning to offer extra large servings of beverage in beverage receptacles of at least one quart capacity. An extra large cup is designated "XLC" and an extra large reusable container, for example a pitcher, is designated "P". The XLC cup is typically paper and has a fluid capacity of at least one quart or 32 fluid ounces. The largest known XLC cup being presently used is 44 fluid ounces. Extra large cups of up to 60 ounces may soon be tested. The extra large reusable receptacle "P" is also of at least one quart capacity and may commonly be of two quarts capacity or even larger.

Figure 2:
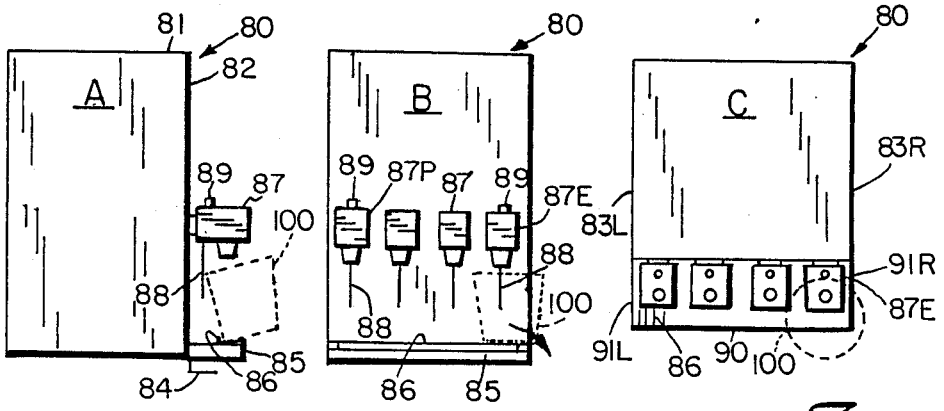
PRIOR ART Fig. 2
FIG. 2 is an illustration of the prior art carbonated beverage dispenser.

FIG. 2 illustrates the prior art dispenser, generally indicated by the numeral 80, which has a housing 81, with a front 82, a pair of sides 83L, 83R, and a cup rest support 84. The cup rest support 84 supports a drip tray 85 and a cup rest 86 on the drip tray 85. In certain dispensers, the support 84 and drip tray 85 may be a single structure. A plurality of carbonated beverage dispensing valves 87 are mounted in a row extending across the dispenser front 82. Each valve 87 has an actuator and at least one valve 87P may have an electrically conductive combination actuator lever and beverage level probe 88. This probe equipped valve 87P will have an electronic control 89 such as disclosed in McIntosh, Reichenberger, or Bennett or one of the subsequent improvements thereon, which is electrically connected to the probe 88 and to a dispensing actuator switch 94 for the valve 87P. When a cup is placed upon the cup rest 86 and pushed against the probe 88, dispensing is started when the probe 88 closes the dispensing switch 94. Beverage is then dispensed into the cup and as the cup fills the beverage level rises toward the cup rim. When the beverage dispensed into the cup approaches or reaches the cup rim and makes physical contact with the probe 88, an electrical signal is sent through beverage in the cup and through the probe 88 to the control 89 and the control 89 then terminates dispensing. This provides an automatic shut off of dispensing when the beverage level is at the cup rim, regardless of the size of the cup and regardless of how much ice is in it. The existing dispenser 80 handles and works well with the standard sized cups S, M and L and these cups can be placed upon the cup rest 86, and left there unattended while the person does other work, and the person may subsequently return and find the standard cup S, M, L filled to the rim and that the dispenser 80 is automatically shut off, regardless of which standard cup S, M or L was selected and used.

However, if an extra large receptacle 100 (such as either the extra large cup XLC or pitcher P) is to be utilized on the existing dispenser 80, the extra large receptacle 100 is too big for the cup rest 86 and will fall off the front of the cup rest 86 as shown in FIG. 2-A or fall off to one side from under an end dispensing valve 87E as shown in FIG. 2-B. The person operating the dispenser must manually hold the extra large receptacle 100 during filling and automatic shut off and the economic value of the person's time cannot be used for other purposes. Normally, the best selling beverage, or the two best selling beverages are in the outer end dispensing valves 87E so that it's easy to use both of them concurrently. FIG. 2-C best illustrates the "footprint" of the original cup rest 86 as defined by the dispenser front 82, the drip tray and cup rest front edge 90 and side edges 91L, 91R which are generally co-planar with the dispenser sides 83L, 83R respectively. As the diametric profile of the extra large receptacle 100 clearly shows, the receptacle 100 can easily fall to the side or to the front of the original cup rest 86.

Figure 3:
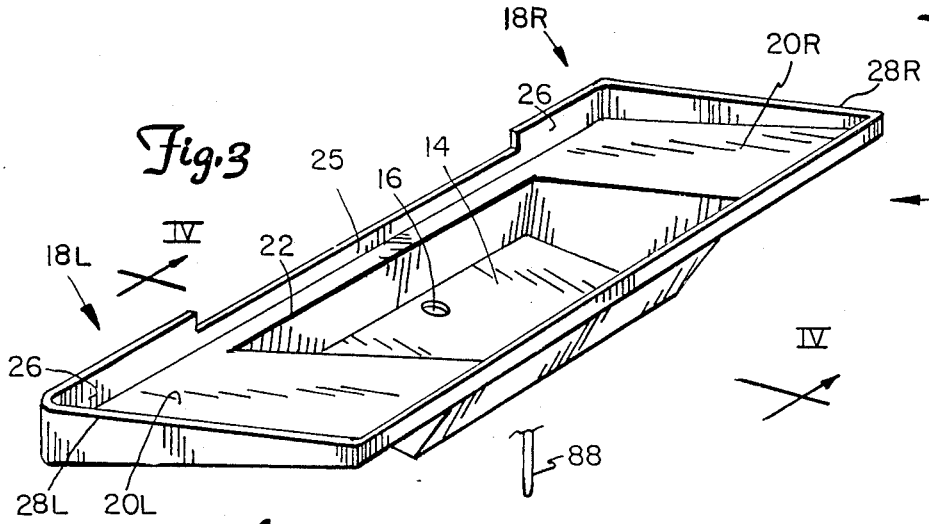
FIG. 3 is a perspective view looking downward on the improved drip tray of the present invention.
Figure 4:
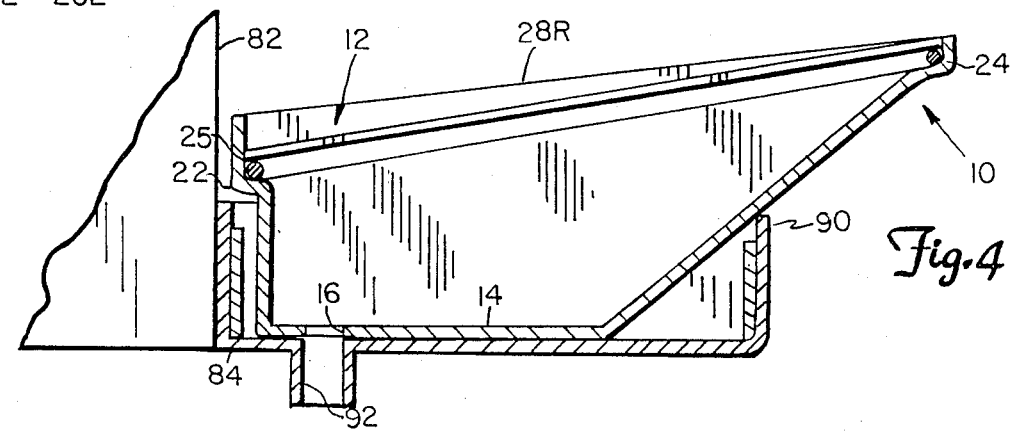
FIG. 4 is an elevational cross section view taken through lines IV—IV of FIG. 3.

Important features of the present invention are the improved drip tray and receptacle rest shown best in FIGS. 3 and 4 and generally indicated by the numerals 10 and 12 respectfully.

The improved drip tray 10 has a central sump 14 with a drain 16. The sump 14 is configured to be generally horizontal when in use and is configured to engage the existing dispenser rest support 84 for support of the tray 10 and receptacle rest 12. The sump 14 is directly under the nozzles of all of the dispensing valves 87. A transversely extending wing generally indicated by the numerals 18L, 18R extends transversely outward from each side of the central sump 14. Each wing 18L, 18R has a floor 20L, 20R for directing beverage overflow into the sump 14. At the rear of the drip tray 10 is a rear receptacle rest support 22 which extends all the way across the sump 14 and both wings 18L, 18R. On the front and upper edge of the drip tray 10 is a nose 24 which extends all the way across the width of the sump 14 and both wings 18L, 18R and provides a front and upper receptacle rest support for the receptacle rest 12. The nose 24 is spaced upward from and is spaced outward from the front edge 90 of the original footprint of the original drip tray 85 and cup rest 86. The receptacle support 12 is tilted or canted downwardly toward the dispenser front 82 and probe 88, and is supported all along its transverse length by the rear receptacle rest support 22 and the nose 24. The wing floors 20L, 20R are directly under the receptacle rest 12 and are likewise tilted or canted to the rear. A preferred angle of tilt or cant is at least twelve degrees. At the bottom of each floor, to the rear of the sump 14 is a drip lip 25 which tucks under the dispenser front 82. At the bottom or rear side of each wing 18L, 18R is an upright weir 26 for directing any overflow on the wing floors 20L, 20R to the sump 14. The sump drain 16 is preferably arranged to drain into an existing drain 92 of the dispenser 80.

An important feature of the improved drip tray 10 is that the nose 24 is spaced significantly upward of and forward out beyond the original front edge 90 of the original cup rest 86 and/or drip tray 85. The nose 24 is also elevated from and is at level above the rear receptacle support 22. The nose 24 and rear receptacle support 22 together define a canted support structure upon which the beverage receptacle rest 12 is placed. Each wing 18L, 18R has an outer lip 28L, 28R which extends upward above the wing floor 20L, 20R and above the receptacle rest 12 for stiffening the wings 18L, 18R and for keeping overflow on the wings 18L, 18R. The improved receptacle rest 12 extends completely across the entirety of the improved drip tray 10 and across both wings 18L, 18R to the outer lips 28L, 28R. The improved drip tray 10 has no undercuts and is preferably fabricated of vacuum formed plastic.

Figure 5:
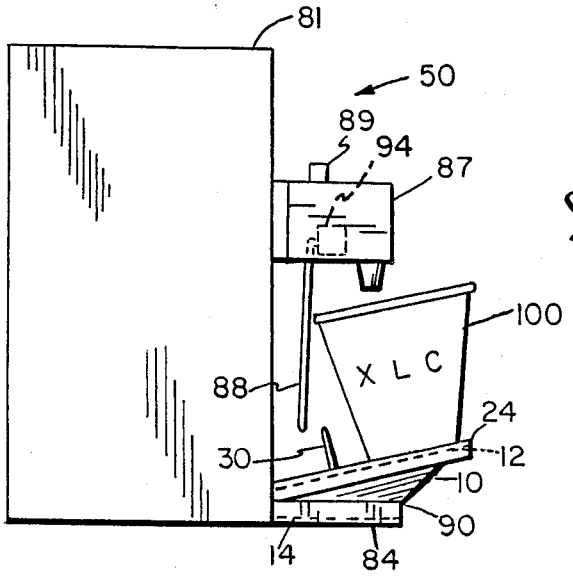
FIG. 5 is an elevational side view of the preferred beverage dispenser of the present invention.
Figure 6:
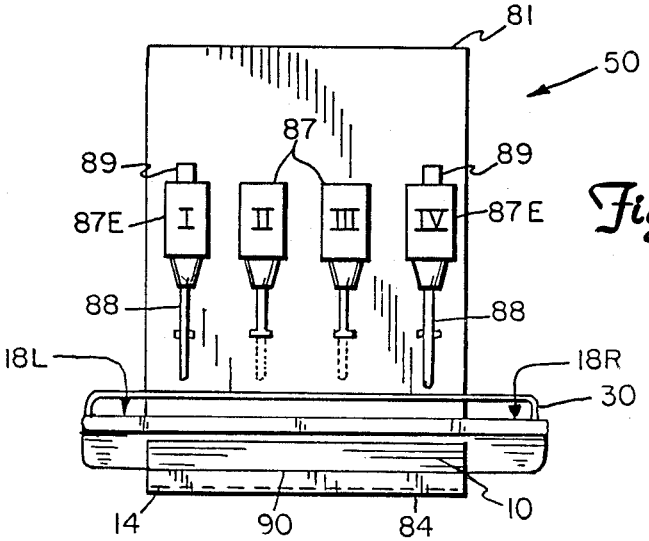
FIG. 6 is an elevational front view of the structure of FIG. 5.
Figure 7:
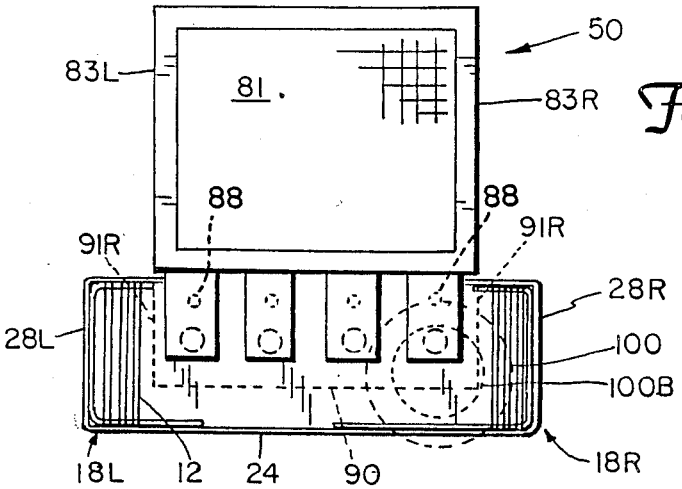
FIG. 7 is a top plan view of the structure of FIG. 5.

The improved dispenser of the present invention is best shown in FIGS. 5–7 and is generally designated by the numeral 50. The improved dispenser 50 will most often be made from the original dispenser 80 by a new method of refitting wherein an existing dispenser 80 for cups is modified and retrofitted into an improved dispenser 50 for filling any receptacle selected from those shown in FIG. 1 with automatic shut off of dispensing when the beverage reaches the rim of the selected receptacle and with full and stable support of the extra large receptacles 100 so that the dispenser operator can place the selected receptacle(s) upon the improved dispenser 50 and walk away and leave the dispenser unattended. The operator can subsequently return and remove the filled receptacle, regardless of whether its a standard cup S, M, L or an extra large receptacle 100.

In the method of retrofitting the original dispenser 80 to make the improved dispenser 50, the original cup rest 86 and in many cases the original drip tray 85 are removed. On some dispensers the drip tray 85 is welded and/or permanently fastened to the housing 81; these cannot be removed. The improved drip tray 10 is placed upon the original structure for supporting the original cup rest 86 and/or the original drip tray 85 as the case may be. The improved and enlarged receptacle rest 12 is placed upon the improved drip tray 10.

The original dispenser 80 which is being retrofitted, is most likely to have a plurality of solenoid operated dispensing valves 87 and will not have the automatic shut off feature of McIntosh. At least one of the dispensing valves 87 will be retrofitted with a generally vertical and elongate electrically conductive combination actuator lever and beverage level probe 88 to which the control 89 may be electrically connected. The probe 88 is vertically positioned in between the dispensing valve 87 and the improved drip tray 10 and receptacle rest 12. The electronic control 89 is appropriately mounted and provision is made for operative electrical connection of it to the probe 88 and for a second electrical connection enabling sending of a signal from the control 89 into the beverage being dispensed and into the dispensed beverage in the receptacle. This second connection can be either a second probe as taught by McIntosh or by a connection into the fluid stream as taught by Reichenberger. The highest dispensing volume and therefore the most frequently used valves on the original dispenser 80 are usually the end valves 87E and it is preferable that at least one and preferably both of these end valves 87E be retrofitted with a probe 88 and control 89. Usually all of the dispensing valves 87 will be retrofitted.

A kit for retrofitting the original dispenser 80 into an improved dispenser 50 includes the improved drip tray 10, the improved and enlarged receptacle rest 12, at least one probe 88, and at least one control 89.

This kit and the method of retrofitting enables most of the approximately 400,000 dispensers in the U.S. to be retrofitted to utilize extra large receptacles and provide automatic shut off of dispensing at the receptacle rim for less product loss, less labor cost, and faster serving of customers.

The improved receptacle rest 12 may be provided with a vertically spaced receptacle back stop 30 as has been completely described in my co-pending referenced application. This back stop will extend transversely of the dispenser sides 83L, 83R and over both wings 18L, 18R as shown in FIGS. 5 and 6F and be spaced up above the receptacle rest 12 and be below the probes 88.

As clearly shown in FIGS. 5 and 7, the improved drip tray nose 24 and receptacle rest 12 both extend at an incline up and over and outward beyond the original outer forward edge 90 and footprint of the original drip tray 85 and cup rest 86. This canted extension of the nose 24 and receptacle rest 12 enables complete and stable support of extra large receptacles 100 in front of all of the central dispensing valves 87.

The wings 18L and 18R and the receptacle rest 12 all extend transversely beyond the dispenser sides 83L, 83R and the original cup rest sides 91L, 91R and provide complete and stable support of the extra large receptacles 100 in front of the end dispensing valves 87E by supporting the extra large receptacle base 100B both above and forward of the original cup rest front edge 90 and transversely outward beyond the dispenser sides 83L, 83R and original cup rest sides 91L, 91R as is clearly shown in FIG. 7. As FIG. 7 clearly shows, the canted footprint of the improved and enlarged drip tray 10 and receptacle rest 12 is enlarged to the front and to the sides beyond the footprint of the original drip tray 85 and cup rest 86, as well as beyond the sides 83L, 183R, the original dispenser 80.

In the use of the improved dispenser 50 and in the practice of the improved method of dispensing in the present invention, any beverage receptacle is selected from the group shown in and described with respect to FIG. 1. The selected receptacle is placed upon the improved drip tray 10 and receptacle rest 12 and tilted rearward and pushed downward and rearward until its upper rim contacts the probe 88. Dispensing of beverage into the receptacle is started either by movement of the probe 88 against the actuator switch or by discrete actuation of a actuator switch which may be remote from the dispensing valve 87.

When the level of beverage dispensed into the receptacle approaches or reaches the lowest level of the receptacle rim, the dispensed beverage will make physical contact with the probe 88 and an electrical signal will be sent and received by the control 89 through the beverage in the receptacle. In response to electrical sensing of the presence of beverage adjacent to the receptacle rim, the control 89 will automatically shut off dispensing.

Figure 8:
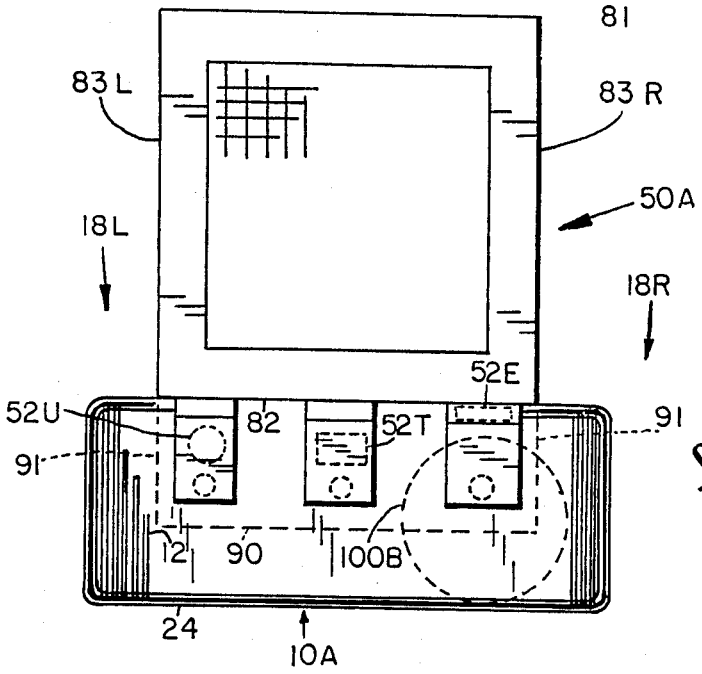
FIG. 8 is a top plan view of a further embodiment of the present invention.
Figure 9:
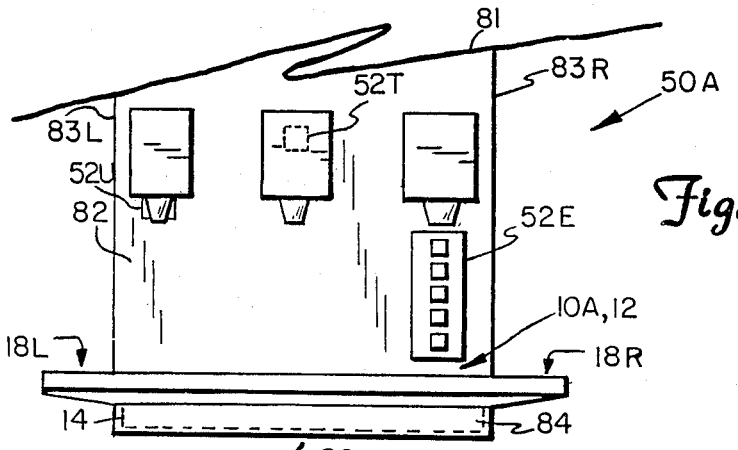
FIG. 9 is a front elevational view of the structure of FIG. 8.
Figure 10:
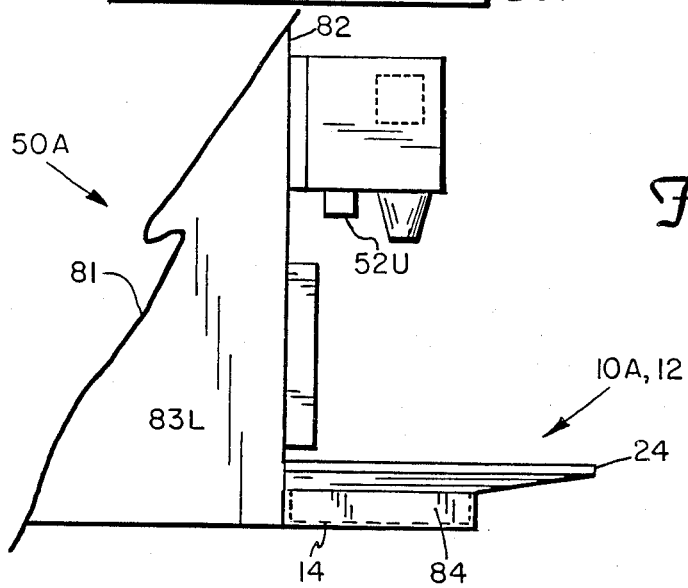
FIG. 10 is a side elevational view of the structure of FIG. 8.

FIGS. 8–10 illustrate a further embodiment of this invention wherein an alternative improved dispenser 50A has a similarly enlarged and improved drip tray 10A and receptacle rest 12 which are larger and extend beyond the original cup rest footprint 90, 91 as best seen in FIG. 8. This drip tray 10A may be disposed to support the receptacle rest 12 in a generally horizontal configuration. The drip tray 10A and receptacle rest 12 serve to fully support the extra large receptacle base 100B as best shown in FIG. 8 and as previously described. An automatic level responsive fill control 52U, 52T, 52E is provided and connected to the respective dispensing valve 87. An ultrasonic control 52U is shown, a conventional timer 52T is illustrated, and a multilevel electronic eye control 52E which may be of a combination infra-red and indicative emitter receiver is illustrated. With controls 52U or 52T or for that matter the probing type sensor of Reichenberger U.S. Pat. No. 4,236,553, together with the relatively horizontal improved and enlarged drip tray 10A and receptacle rest 12, an existing dispenser 80 can be easily retrofitted into an improved dispenser 50A which will dispense into any of small cups and extra large receptacles with unattended automatic shut off of dispensing adjacent the rim of the receptacle.

Thus the employee is free to go about and do other productive activities while the dispenser 50A is filling extra large receptacles.

The extra large receptacle 100, when it is the selected receptacle, will be fully and stably supported at its base 100B and all overflow will be caught by the wings 18L, 18R and nose 24.

The improved drip trays 10, 10A, the improved dispensers 50, 50A, the kits for retrofitting an existing dispenser 80 into an improved dispenser 50, 50A, the methods of retrofitting, and the methods of dispensing are all novel, useful and valuable contributions to the state-of-the-art enabling expansion and further use of both new and existing capital equipment for the benefit of both retailers and consumers. The improved dispensers 50, 50A, will both automatically shut off, when unattended, at the receptacle rim, regardless of what receptacle is selected, be it standard sized or extra large.

Although other advantages may be found and realized, and various and minor modifications suggested by those versed in the art, be it understood that I wish to embody within the scope of the patent warranted hereon, all such embodiments as reasonably and properly come within the scope of my contribution to the art.

I claim as my invention:

1. An improved cold carbonated beverage dispenser for filling any individual receptacle selected from a predetermined receptacle group of standard size beverage cups of less than a quart capacity and at least one extra large beverage receptacle of at least one quart capacity, with unattended automatic shut off of the dispensing for all said receptacles when the dispensed beverage level is adjacent the rim of the selected one of said receptacles, comprising (a) a dispenser housing with a front, a left side, a right side, an electrically operable cold carbonated beverage dispensing valve mounted on the front, and cup rest support means on the front for support of a cup rest below said valve;

(b) an elongate electrically conductive beverage probe above the support means and under said one valve for engaging an upper rim of said selected receptacle when said selected receptacle is placed under said one valve for being filled therefrom;

(c) a dispensing switch operably connected to effect opening of said one valve for starting dispensing therefrom into said selected receptacle;

(d) automatic control means electrically connected to the probe and disposed in combination with the dispensing switch and the dispensing valve for effecting closing of the valve and stopping of dispensing when the level of dispensed beverage in said selected receptacle reaches or approaches the upper rim of said selected receptacle and touches the probe and the dispensed beverage level is thereby electrically sensed by the control means;

(e) an improved drip tray supported by said cup rest suppport means, said drip tray having an outer nose extending upward from and forward beyond said cup rest support means for supporting a rearwardly inclined receptacle rest, and means for directing spilled beverage rearward and downward from said nose, and (f) an improved rearwardly inclined receptacle rest on said improved drip tray, said receptacle rest extending over and forward beyond said cup rest support means to said nose for stably engaging and supporting an inclined base of an inclined said extra large beverage receptacle, said extra large receptacle being tilted rearward toward said probe when supported by said receptacle rest.

2. The dispenser of claim 1, wherein said beverage dispensing valve is transversely outermost on said dispenser front, and is immediately adjacent to one of said dispenser sides, said improved drip tray including a tray wing extending transversely outward beyond said one dispenser side, with said receptacle rest having a rest wing likewise extending out into said drip tray wing, for engagement and inclined support of the inclined base of said extra large beverage receptacle transversely beyond said one side of said dispenser.

3. The dispenser of claim 2, including a pair of said beverage dispensing valves mounted one on each opposite outer transverse end of the dispenser front, said improved drip tray having one said tray wing on each end thereof, said receptacle rest having one said rest wing on each end thereof, said drip tray and receptacle rest both extending transversely beyond the cup rest support means and outwardly beyond both sides of the dispenser, for inclined support of the inclined extra large beverage receptacle beyond either side of the dispenser under either of said pair of dispensing valves.

4. The dispenser of claim 3, wherein said drip tray outer nose extends transversely and forward of said cup rest to an outer end of each tray wing.

5. The dispenser of claim 3, including a receptacle stop mounted along and above the lower end of the receptacle rest, said receptacle stop extending transversely outward beyond said housing and over each drip tray wing and each receptacle rest wing.

6. The dispenser of claim 3, wherein each tray wing includes structure comprising means for supporting said receptacle rest.

7. The dispenser of claim 3, wherein each drip tray wing includes a bottom underneath the respective receptacle rest wing, said bottom comprising means for directing spillage toward the center of the drip tray.

8. The dispenser of claim 7, wherein each drip tray wing bottom is rearwardly inclined.

9. The dispenser of claim 8, including a transverse drainage weir at the rear edge of each drip tray wing.

10. The dispenser of claim 2, wherein said drip tray outer nose extends transversely and forward of said cup rest support means to an outer end of the tray wing.

11. The dispenser of claim 1, wherein said improved drip tray includes a central sump section which is fitted to and inserts within an original drip tray support upon the dispenser.

12. The dispenser of claim 11, including a drain out of said central sump section into said original drip tray.

13. The dispenser of claim 1, including a receptacle backstop extending transversely across the width of the dispenser, said backstop being spaced above said receptacle rest and being underneath said probe.

14. A method of dispensing beverage from a single dispenser into any beverage receptacle selected from a predetermined group of standard sized beverage cups and at least one extra large beverage receptacle which is of greater size and capacity than any of the cups and which has a fluid capacity of at least one quart, with unattended automatic shut off of dispensing when dispensed beverage reaches or approaches the rim of the selected receptacle regardless of which of the group the selected receptacle is, comprising the steps of (a) selecting any one receptacle from said receptacle group and placing the selected receptacle upon a rearwardly inclined receptacle support surface and tilting the selected receptacle to the rear, (b) moving the rearwardly tilted selected receptacle rearward and downward upon the rearwardly inclined support surface and into physical contact with an electrically conductive beverage level probe;

(c) starting dispensing of beverage into said selected receptacle;

(d) electrically sensing the dispensed beverage with the probe as the dispensed beverage level in the selected receptacle reaches or approaches an upper rim of the selected receptacle and touches the probe;

(e) automatically terminating dispensing upon such sensing; and (f) completely supporting a base of said selected beverage receptacle during the steps of dispensing and sensing and terminating, said supporting being done above and beyond a footprint of an original cup support upon said dispenser with an enlarged and inclined beverage receptacle support which is extended upward from and outward beyond said footprint for stably physically engaging the base of said selected beverage receptacle beyond said footprint.

15. A method according to claim 14, wherein the entire inclined base of the said extra large beverage receptacle is fully physically engaged by said enlarged and inclined beverage receptacle support.

16. A method according to claim 14, in which said selected beverage receptacle is supported at least in part transversely beyond a side of said dispenser by a wing on said beverage receptacle support, said wing having said rearward inclination and being extended transversely beyond a side of the dispenser.

17. A method according to claim 16, including the further step of catching any overflow or spillage from said selected beverage receptacle in said wing, and directing the caught beverage to toward the center of the dispenser.

18. A method according to claim 14, in which the angle of inclination is at least twelve degrees.

19. A method according to claim 14, in which said at least one extra large beverage receptacle is of at least forty-four fluid ounces in capacity.

20. A method according to claim 14, in which said at lest one extra large beverage receptacle is a reusable beverage pitcher.

21. A method according to claim 20, plus the step of stopping and supporting the pitcher so that it cannot bend the probe.

22. An improved cold carbonated manual beverage dispenser for filling any individual receptacle selected from a predetermined receptacle group of standard size beverage cups of less than a quart capacity and at least one extra large beverage receptacle of at least one quart capacity, with unattended automatic shut off of the dispensing for all said receptacles when the dispensed beverage level is adjacent the rim of the selected one of said receptacles, comprising:

(a) a dispenser housing with a front, a left side, a right side, an electrically operable cold carbonated beverage dispensing valve mounted on the front, and original cup rest support means on the front for supporting an original cup rest below said valve, said original cup rest support means defining an original cup rest footprint;

(b) A dispensing switch operably connected to effect opening of said valve for starting dispensing therefrom into said selected receptacle;

(c) beverage level sensing automatic receptacle fill control means electrically connected to and in combination with the dispensing switch and the dispensing valve for effecting closing of the valve and stopping of the dispensing when the level of dispensed beverage in said selected receptacle reaches or approaches the upper rim of said selected receptacle and is thereby sensed by the control means;

(d) an improved and enlarged drip tray supported by said original cup rest support means, said drip tray having an outer nose extending upward of and frontly forward beyond the front of said original cup rest support means and said original cup rest footprint for supporting a receptacle rest thereon; and (e) an improved and enlarged receptacle rest supported by said drip tray above said nose, said receptacle rest extending forward of the original cup rest support means and forward of the original cup rest footprint and across said nose for complete and stable support of said extra large receptacle beyond the front of the original cup rest support means and original cup rest, during dispensing into the extra large receptacle and automatic dispensing shut off in response to the dispensed beverage level in the extra large receptacle.

23. The improved dispenser of claim 22, in which (a) said improved and enlarged drip tray further includes a pair of wings on opposite ends of said drip tray, each wing extending transversely beyond a respective side of the dispenser housing and forward to said nose; and in which (b) said improved and enlarged receptacle rest extends transversely beyond each side of the dispenser housing and across the width of both wings.

24. A method of manually dispensing cold carbonated beverage from a dispenser into any beverage receptacle selected from a predetermined group of standard sized cold beverage cups of less than a quart capacity and at least one extra large beverage receptacle which is of greater size and capacity than any of the cups and which has a fluid capacity of at least one quart, with unattended automatic shut off of dispensing for all said receptacles when the dispensed beverage level in the selected receptacle reaches or approaches the rim of the selected receptacle regardless of which of the group the selected receptacle is, comprising the steps of (a) selecting any one receptacle from said receptacle group and placing the selected receptacle upon a receptacle support surface and completely supporting the base of any said receptacles;

(b) moving the selected receptacle rearward upon the support surface and starting dispensing in response to sensing the presence of the selected receptacle;

(c) electrically sensing for the level of dispensed beverage in the receptacle as the dispensed beverage level in the selected receptacle rises;

(d) automatically and unattendedly terminating dispensing upon sensing the dispensed beverage to be at a predetermined level with respect to the upper rim of any of said selected receptacle; and (e) completely supporting a base of said selected beverage receptacle during the steps of dispensing and sensing and terminating, said supporting being done at least in part above and beyond the footprint of an original cup support upon said dispenser with an enlarged beverage receptacle support which is extended upward from and outward beyond said footprint for stably physically engaging the base of said selected beverage receptacle.

25. A method according to claim 24, in which said selected beverage receptacle is supported at least in part transversely beyond a side of said dispenser by a wing on said beverage receptacle support, said wing extended transversely beyond a side of the dispenser.

* * * * *